US005143553A

United States Patent [19]

Mukaihira et al.

[11] Patent Number: 5,143,553

[45] Date of Patent: Sep. 1, 1992

[54] CONTROL APPARATUS OF IGNITION CURRENT CONDUCTING TIME

[75] Inventors: Takashi Mukaihira, Katsuta; Noboru Sugiura, Mito; Ryoichi Kobayashi, Toukai, all of Japan

[73] Assignee: Hitachi, Ltd., Tokyo, Japan

[21] Appl. No.: 669,620

[22] Filed: Mar. 14, 1991

[30] Foreign Application Priority Data

Mar. 15, 1990 [JP] Japan ..... 2-62676

[51] Int. Cl.[5] ..... F02P 3/06

[52] U.S. Cl. ..... 123/609; 123/632

[58] Field of Search ..... 123/609, 618, 644, 625, 123/416, 422, 632, 198 DC; 364/431.04

[56] References Cited

U.S. PATENT DOCUMENTS

| | | | |
|---|---|---|---|
| 3,874,355 | 4/1975 | Suda et al. | 123/632 |
| 3,901,205 | 8/1975 | Brungsborg | 123/632 |
| 3,965,878 | 1/1976 | Salway | 123/632 |
| 4,309,973 | 1/1982 | Tamura | 123/609 |
| 4,329,959 | 5/1982 | Javeri | 123/416 |
| 4,347,570 | 8/1982 | Akiyama et al. | 364/431.04 |
| 4,711,226 | 12/1987 | Neuhalfen et al. | 123/609 |
| 4,770,142 | 9/1988 | Hayashi et al. | 123/632 |
| 4,893,605 | 1/1990 | Ozawa | 123/632 |
| 4,915,086 | 4/1990 | Ciliberto et al. | 123/609 |
| 5,007,397 | 4/1991 | Akasu | 123/422 |

FOREIGN PATENT DOCUMENTS

| | | | |
|---|---|---|---|
| 2911043 | 8/1980 | Fed. Rep. of Germany | 123/632 |
| 0214672 | 12/1983 | Japan | 123/632 |

*Primary Examiner*—Raymond A. Nelli

*Attorney, Agent, or Firm*—Antonelli, Terry, Stout & Kraus

[57] ABSTRACT

During an abnormal stop condition of an internal combustion engine, the semiconductor devices which control the supply of current to the ignition coils during a dwell time are subject to damage by a high transient current. To prevent this, at least one prdetermined time interval is selected on the basis of detected engine temperatures and/or battery supply voltage level and this selected time interval is compared to a time period between reference pulses from a crank angle sensor. When the time period between reference pulses exceeds the selected time interval, a stop condition of the engine is indicated and the semiconductor devices which supply ignition current are controlled to shorten the dwell time or entirely stop the supply of current to the ignition coils.

17 Claims, 8 Drawing Sheets $V_B$
18
$\theta_{ad}$
T
16
17
15
6
20
19
7
26
27
M
25
23
24
IGN
INJ
F.CUT
28
29
$\theta_{ad}$ & T SIG GEN CKT
32
$T_i$
31
$T_P$
30
QA/N
WTR TEMP COM CKT
33
ENG STOP M DETN CKT
34
T SET CKT
35
8
N
QA
$V_B$
$T_W$

CONTROL APPARATUS OF IGNITION CURRENT CONDUCTING TIME

FIELD OF THE INVENTION

The present invention relates to a control apparatus for controlling ignition current conducting time of an internal combustion engine. More specifically, the present invention relates to a control apparatus which operates to prevent damage to the power transistor used in an ignition system during an abnormal state when an excessively large current flows to the power transistor on account of an engine stop condition of the vehicle.

BACKGROUND OF THE INVENTION

A power transistor has been used for driving a fuel pump, an ignition coil drive apparatus and an injector drive apparatus of an internal combustion engine. Since such a transistor will likely be damaged by the generated heat of the transistor when the current conducting time of the transistor is too long, some counterplan for preventing the destruction of the transistor must be taken. For instance, such a counterplan is disclosed in FIG. 1 of Japanese Laid-Open No. 52-67425 entitled "Non-contactor type ignition apparatus" and published on Jun. 3, 1977. In this prior publication, the disclosed apparatus operates to detect the temperature rise of the power transistor during normal operation using a thermal sensitive element, such as a thermistor, which is located near the power transistor, and to control the current conducting time by varying the bias level of the power transistor based on the output of the thermal sensitive element, so that the power transistor is maintained below the thermal temperature limit thereof.

According to the prior art mentioned above, the current conducting time to the power transistor is controlled by the output signal of the thermistor which is located near the power transistor. When a large transient current flows during an engine stop condition and the temperature of the engine is high, the power transistor is heated abruptly. However, the temperature increase at that time can not be detected by the thermistor, since it is so abrupt, so that the temperature of the power transistor exceeds its temperature limit and the power transistor is damaged.

SUMMARY OF THE INVENTION

An object of the present invention is to provide a control apparatus for controlling ignition current conducting time of the power transistor appropriately so that the temperature of the power transistor is maintained below the junction temperature limit thereof, even if a large,current flows transiently on account of an engine stop condition.

For attaining the above-mentioned object, the apparatus of the present invention is operated as follows. A first predetermined time is determined corresponding to the cooling water temperature of the internal combustion engine. A second predetermined time is determined correspondign to the battery supply voltage of a control system of the internal combustion engine. When a reference signal from a crank angle sensor is not outputted for a time which is longer than either one of the first predetermined time or the second predetermined time, or the first and second predetermined times, the apparatus judges that the engine has stopped and operates to shorten the conducting time of the semiconductor device.

The cooling water temperature of the internal combustion engine is representative of the temperature of the internal combustion engine. The apparatus of the present invention monitors the cooling water temperature and sets the first predetermined time to be shorter when the cooling water temperature is higher. At the same time, the apparatus of the present invention sets the second predetermined time to be shorter when the supply voltage is higher. By adopting the above-mentioned control, the detection of the engine stop condition is faster when the cooling water temperature is higher, so that the flow time of the large current caused by the engine stopping can be shortened when the temperature of the internal combustion engine is high and the damage to the semiconductor device or the power transistor can be prevented. The drop of the supply voltage is caused when the temperature of the internal combustion engine is low or when the starter motor is operating. Since the second predetermined time is set large at that time, the detection of the engine stopping takes on the basis of the second predetermined time, which is similar in magnitude to that which occurs at the normal operation of the engine, even if the first predetermined time is set to be small, since the ambient temperature is high. Accordingly, the second predetermined time is the same as the normal conducting time of the semiconductor device at such an occasion. Accordingly, the semiconductor device does not generate a large amount of heat when the supply voltage is decreased even when the ambient temperature is high. In accordance with the present invention, the ignition current conducting time (dwell) can be controlled based on the first and second predetermined times.

DETAILED DESCRIPTION OF THE PREFERRED EMBODIMENTS

Figure 1:
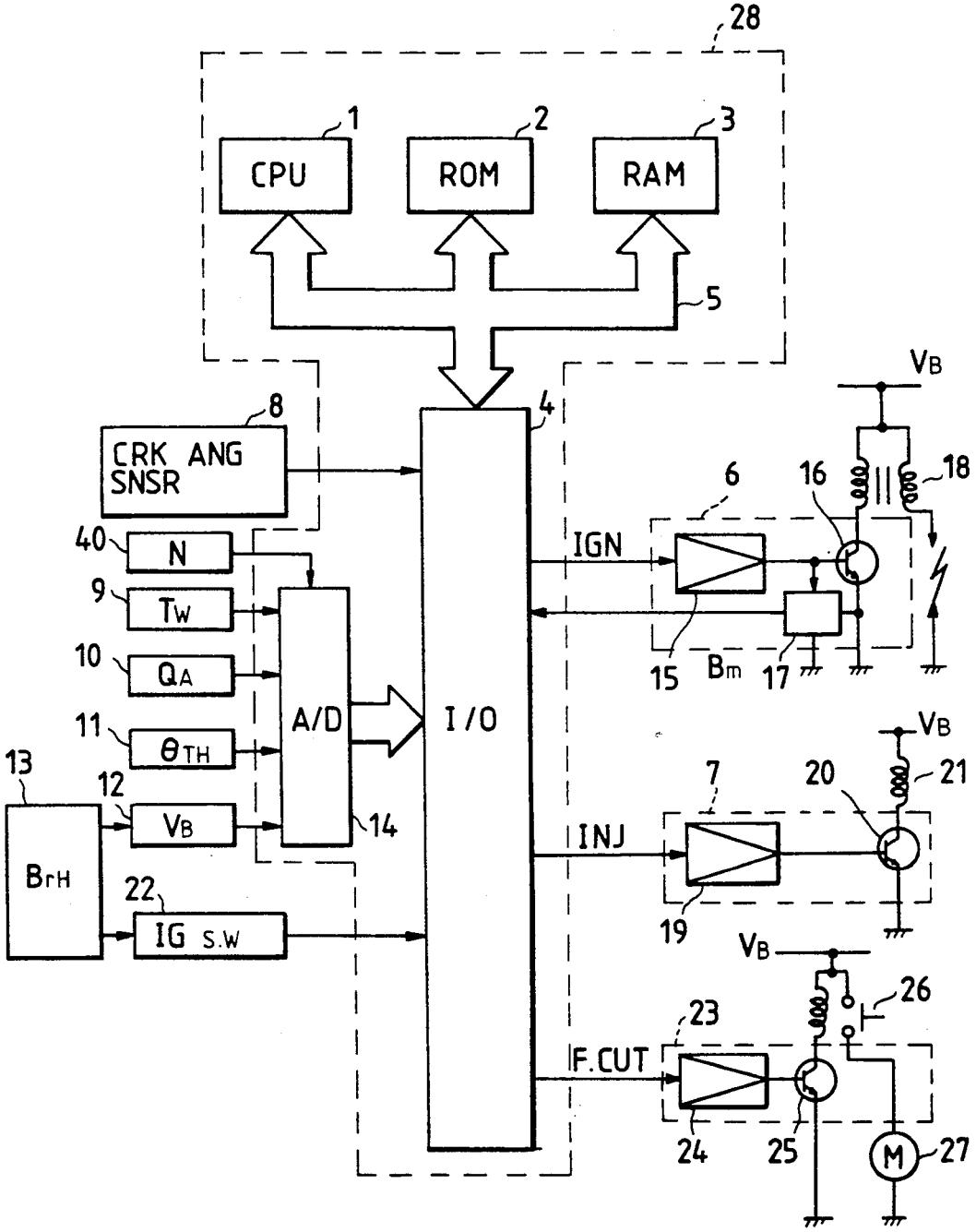
FIG. 1 shows one embodiment of the apparatus used for the present invention.

Referring to FIG. 1, CPU 1 comprises a central processing unit which carries out a digital processing of each kind of data such as an engine ignition timing, an ignition current conduction time and a fuel injection timing, ROM 2 is a memory for storing control programs of the ignition timing and for controlling the ignition current conducting time and fixed data, and RAM 3 is a memory which is able to read out and write data. An input and output interface circuit 4 (hereunder, I/O) inputs signals from various sensors, outputs them to CPU 1 through bus 5, and outputs the ignition timing and the ignition current conducting time signal IGN and the fuel injection timing signal INJ to each of driving circuits 6 and 7, after the IGN and INJ are calculated at CPU 1. In the embodiment, output signals from a crank angle sensor 8 and an ignition switch 22, which are outputted in the form of pulse signals, are inputted directly to I/O 4. As sensors which output analog signals, there are a detecting device of water temperature Tw, a detecting device of air flow quantity Qa, a sensor 11 of the throttle angle 8th, a detecting device 12 of a voltage Vb of a battery 13, and a detection apparatus for detecting the rotation speed N of the engine. Those output signals from the sensors are inputted to an analog/digital converter (A/D) 14, converted to digital signals, and outputted to I/O 4. The crank angle sensor 8 is provided for obtaining reference signals which are used as a basis for calculation of a basic ignition timing. The water temperature Tw and the throttle angle 8th is used for compensating the ignition timing, the ignition current conducting time and the fuel injection timing control. The air flow quantity Qa is used for controlling an air/fuel ratio. The ignition control driver 6 comprises an amplifier for the ignition signal IGN, a Darlington type power transistor 16, and an ignition current conducting time control circuit 17. The ignition current driver 7 generates a high voltage to an ignition coil 18 corresponding to primary break current thereof, when the power transistor is turned off according to the ignition signal IGN. The fuel injection driver 7 comprises an amplifier 19 for the fuel injection signal INJ and a power transistor 20. The fuel injection driver operates an injector 21, when the fuel injection signal INJ is inputted thereto. A fuel pump driver 23 comprises an amplifier 24 for a fuel cut signal F.CUT which is generated during an eingine stop condition, and a power transistor 25. The fuel pump driver operates a solenoid switch 26 based on the fuel cut signal F.CUT, and stops the fuel pump 27 so that the fuel is cut.

Figure 2:
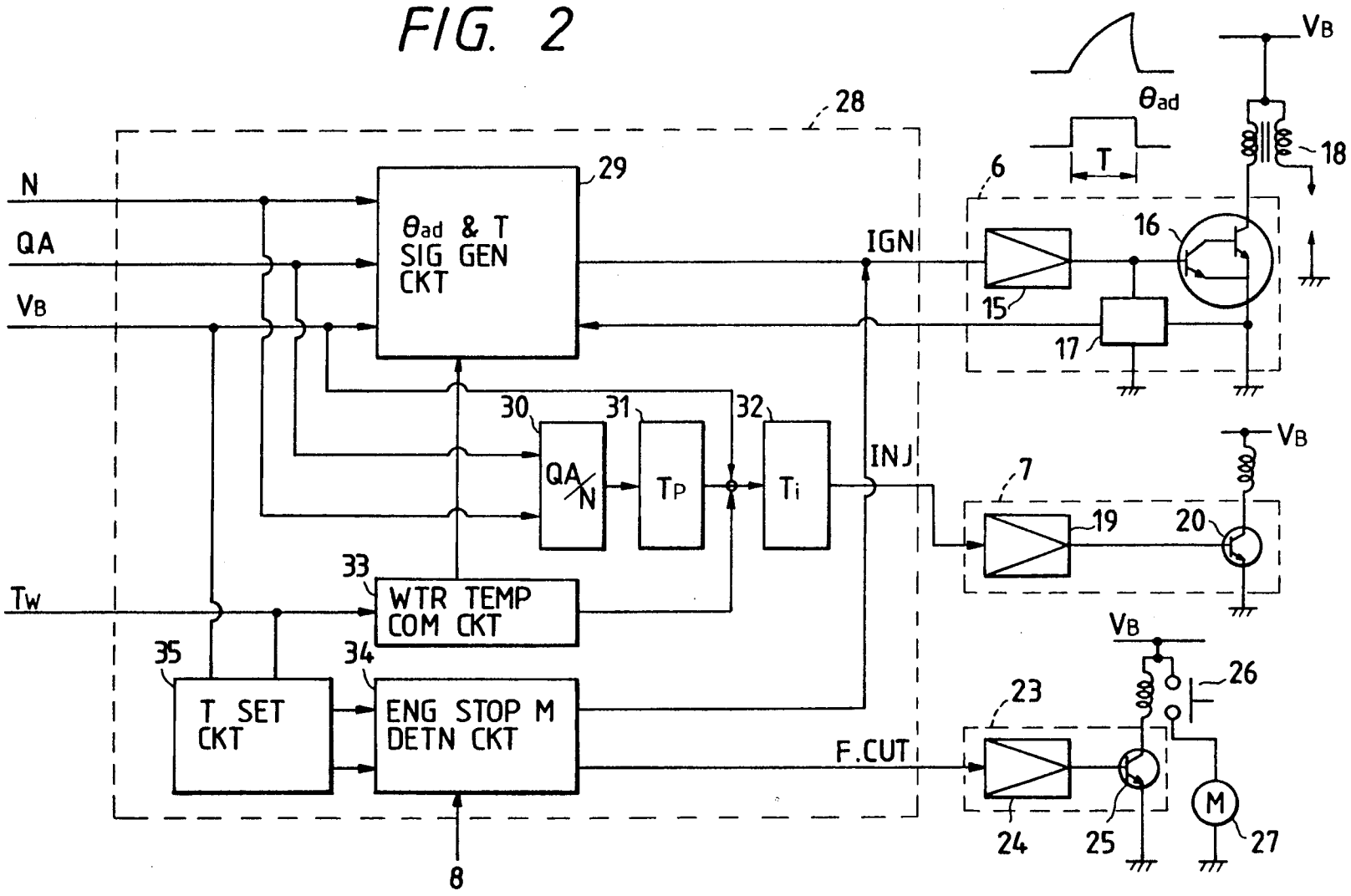
FIG. 2 shows a processing circuit of the ignition control of the present invention.

FIG. 2 shows a block diagram of a control circuit 28 of the ignition current conducting time. The control of the ignition current conducting time is performed by CPU 1, ROM 2, RAM 3 and I/O 4 shown in FIG. 1. Referring to FIG. 2, the engine rotation speed N, the air flow quantity Qa and the supply voltage Vb are inputted to a processing circuit 29 for calculating the ignition timing 8ad and the current conducting time T of the ignition coil and outputs the ignition signal IGN to the driving circuit 6. The processing circuit 30 calculates a load signal Qa/N based on the engine rotation speed N and the air flow quantity Qa. The processing circuit 31 calculates the basic injection pulse width Tp based on the output signal from the processing circuit 30. A water temperature compensation circuit 33 is used for compensating for the cooling water temperature of the internal combustion engine. The processing circuit 32 calculates an actual injection pulse width Ti using output signals of the processing circuit 31, the battery supply voltage Vb and the water temperature compensation circuit 33.

Figure 3:
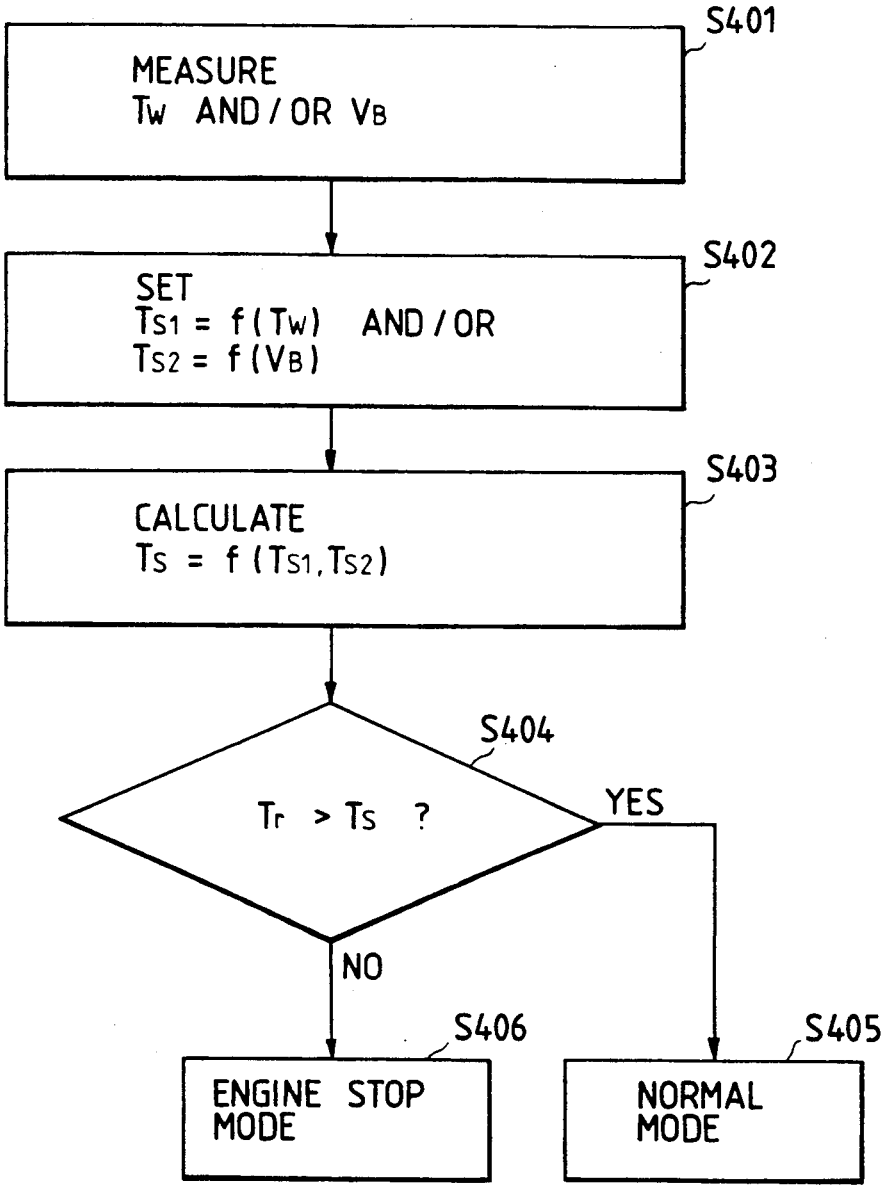
FIG. 3 shows the first flow chart of the ignition current conducting time control of the present invention.

Referring to FIG. 3, the cooling water temperature Tw and/or the battery voltage Vb are detected in step 401. A first current conducting time Tsl and/or a second current conducting time Ts2 are calculated in step 402. Ts1 and Ts2 are a function the detected cooling water temperature Tw and the detected battery voltage is larger as shown in FIGS. 7A, 7B, 7C, 8A, 8B and 8C. These functions are represented as follows:

$Ts1 = f(Tw)$ $Ts2 = f(Vb)$

Referring to FIGS. 7A, 7B, 7C, 8A, 8B and 8C, the first current conducting time Ts1 and the second current conducting time Ts2 become linearly smaller, stepwise and slopewise, when the cooling water temperature Tw or the battery supply voltage Vb is raised. In step 403, the current conducting time Ts is calculated based on Ts1 and/or Ts2 obtained at step 402 by the operation of the time setting circuit 35. The function of Ts includes the condition that either Ts1 or Ts2 may be zero. In step 404, a waiting time Tr, in which the crank angle signal is not outputted to the engine stop mode detecting circuit 34, is compared with Ts obtained at step 403. The comparison of $Tr > Ts$ at step 404 takes place in response to the engine stop mode determination circuit 34. When $Tr > Ts$, the engine stop mode detecting circuit 34 discriminates that the engine has stopped. When $Tr < Ts$, the detecting circuit 34 discriminates that the engine is normal. When the engine stop mode is detected by the detecting circuit 34, the detecting circuit 34 outputs a signal to stop the ignition signal IGN and generates the fuel cut signal F.CUT to stop the fuel pump 27 at once.

Figure 4:
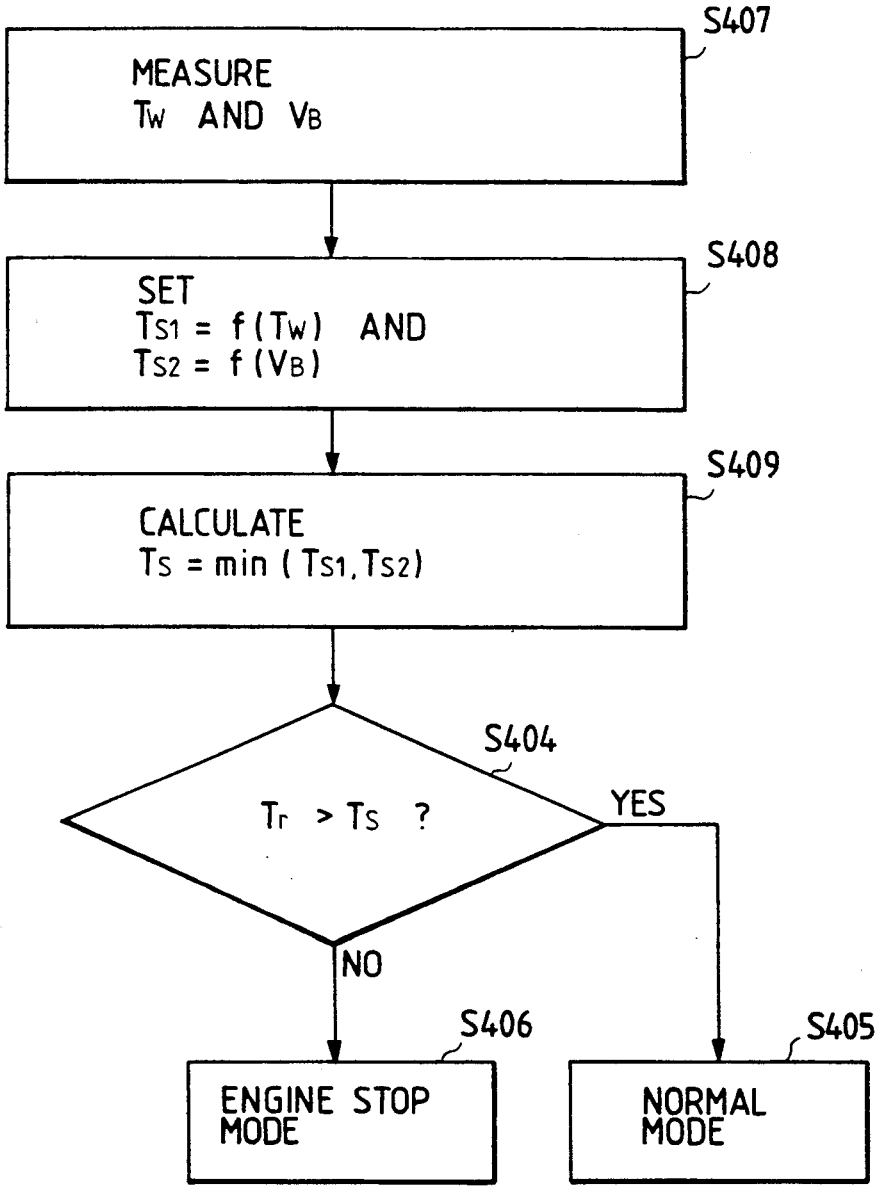
FIG. 4 shows the second flow chart of the ignition current conducting time control of the present invention.

Referring to FIG. 4, Tw and Vb are detected at step 407. Ts1 and Ts2 are set in step 408. In step 409, the time setting circuit 35 selects a smaller current conducting time between the first current conducting time Ts1 and the second current conducting time Ts2. By adopting the function of $Ts = \min(Ts1, Ts2)$, the system shown by the. flow chart of FIG. 4, the control apparatus can perform the most effective safety control to prevent damge to the power transistor 16. The discrimination of $Tr > Ts$ at step 404 is carried out in the engine stop mode determination circuit 34. The control circuits 6 and 23 are operated according to the judgements of steps 405 and 406.

Figure 5:
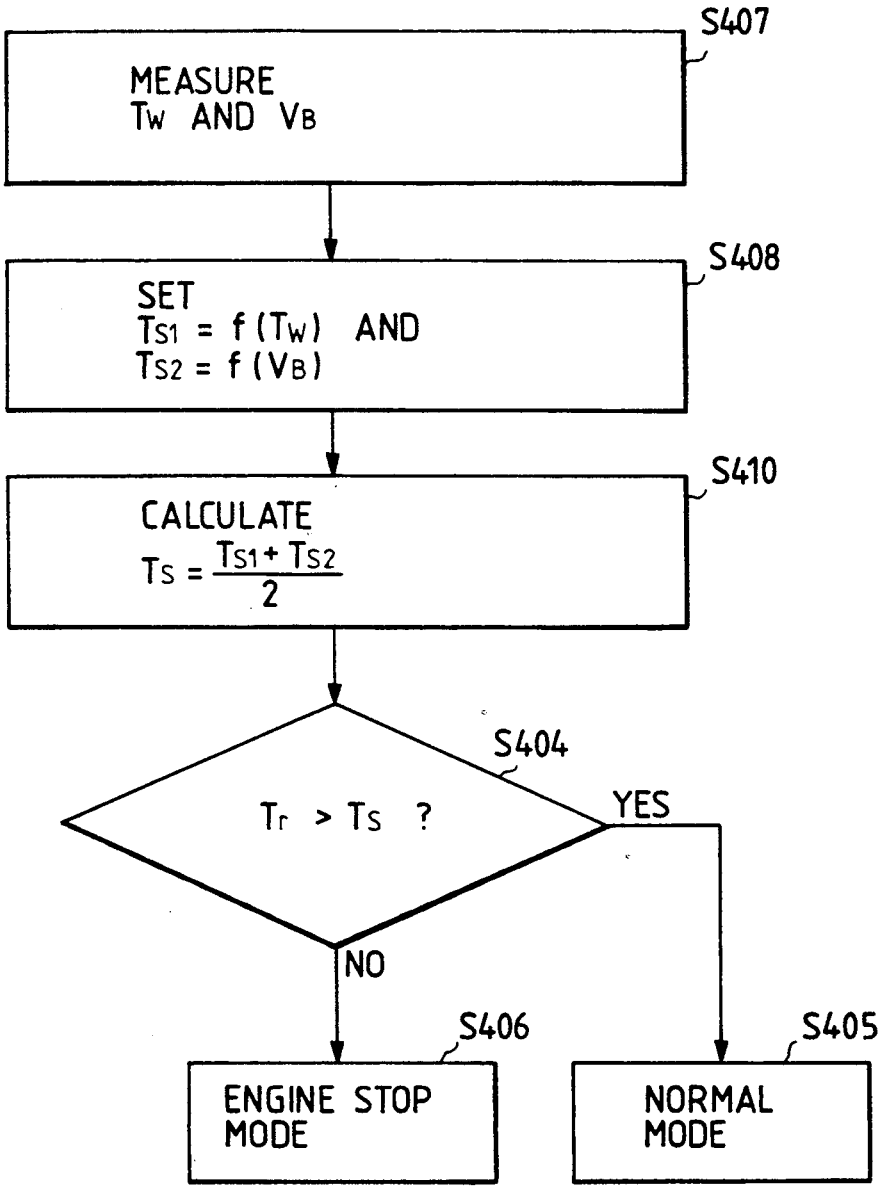
FIG. 5 shows the third flow chart of the ignition current conducting time control of the present invention.

Referring to FIGS. 5, the same parts as in FIG. 4 are indicated by the same symbol. In step 410, calculation of $Ts1 + Ts2/2$ takes place at the time setting circuit 35.

Figure 6:
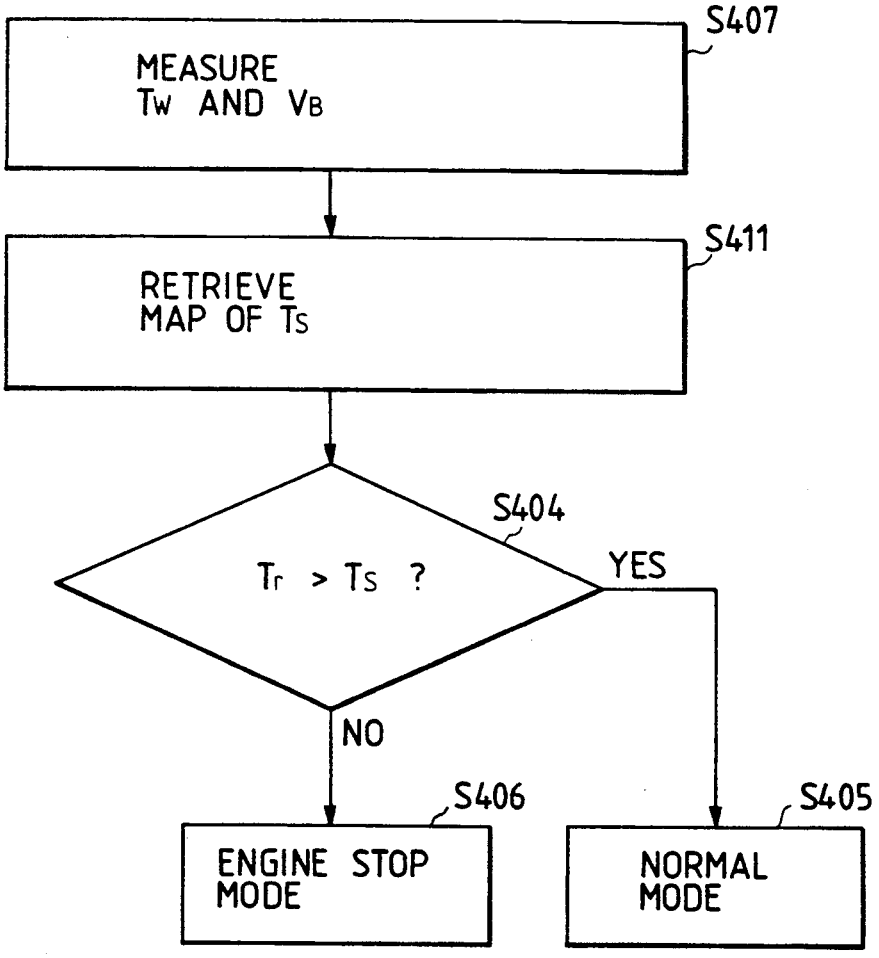
FIG. 6 shows the 4th flow chart of the ignition current conducting time control of the present invention.
Figure 7A:
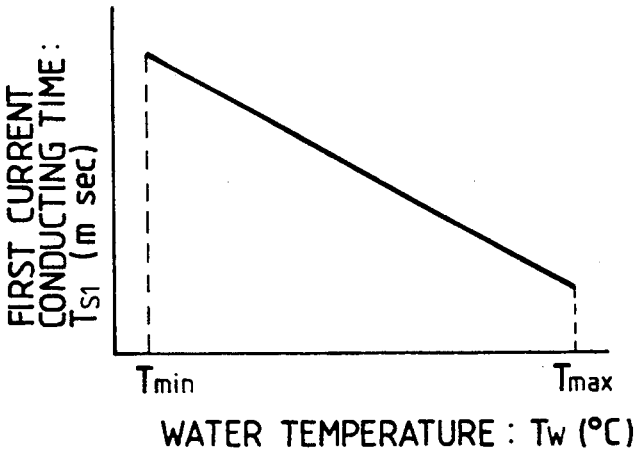
FIGS. 7A, 7B and 7C show characteristic diagrams which are used for determining the first predetermined time corresponding to the cooling water temperature of the internal combustion engine, respectively.
Figure 7B:
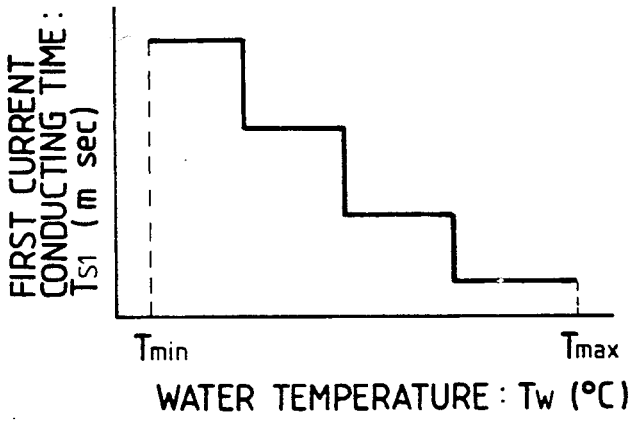
Figure 7C:
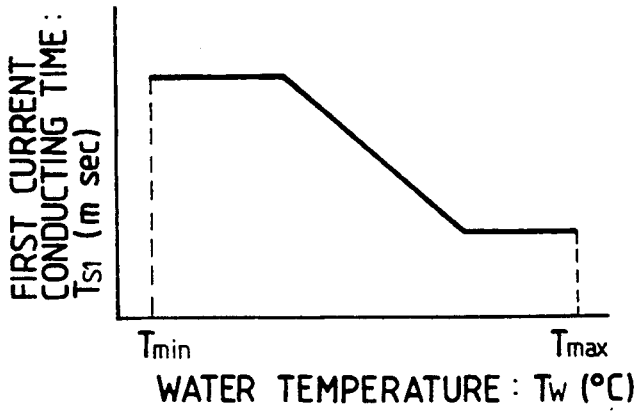
Figure 8A:
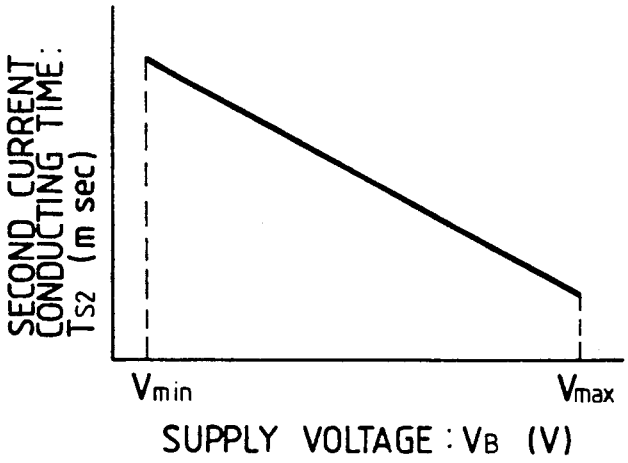
FIGS. 8A, 8B and 8C show characteristic diagrams which are used for determining the second predetermined time corresponding to the battery source voltage of the internal combustion engine, respectively.
Figure 8B:
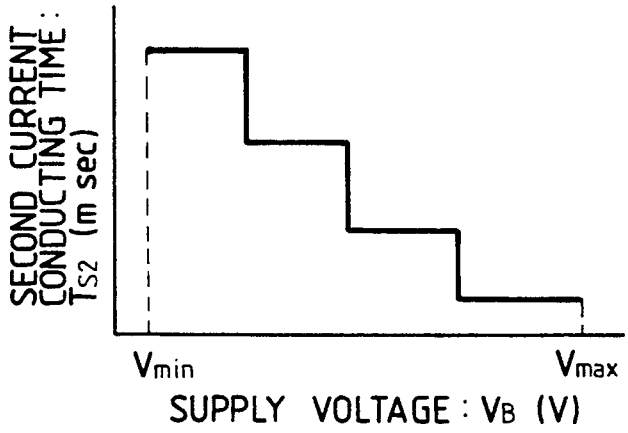
Figure 8C:
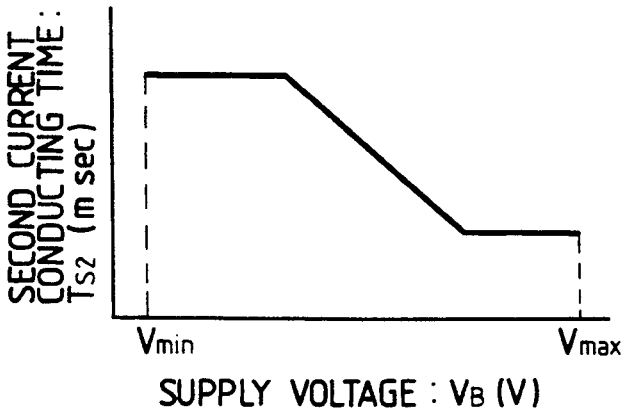

Referring to FIG. 6, the same parts as in FIG. 4 are indicated by the same symbol. The map retrieve of Ts shown at step 411 takes place at the time setting circuit 35 based on the detected values of Tw and Vb. According to the system shown by FIG. 6, the control apparatus performs accurate control of the ignition current conducting time of the power transistor 16 by the map retrieval of Ts mentioned above.

According to the present invention, the semiconductor device for driving the ignition coil can be prevented from becoming damaged, even if the transient large current is going to flow to the semiconductor device on account of the engine stop condition which causes a high temperature, since the control apparatus of the present invention detects the condition which an produce the large current and stops the current conduction to the semiconductor device.

What we claim is:

1. A control apparatus for controlling the dwell time in an ignition circuit of an internal combustion engine by controlling a semiconductor device through which current is supplied to an ignition coil of said ignition circuit, comprising:

a water temperature sensor for detecting the water temperature of cooling water of said engine;

control means for controlling said semiconductor device to conduct for a dwell time during which current is supplied to said ignition coil;

time setting means for selecting a predetermined time interval which is inversely proportional to detected water temperature;

discrimination means for detecting that said engine is in a predetermined state when a time period, during which a reference signal from a crank angle sensor is not outputted, is larger than said selected predetermined time interval; and means responsive to said discrimination means detecting said predetermined state for controlling said control means to shorten said dwell time by a predetermined amount.

2. A control apparatus according to claim 1, wherein said predetermined state represents an engine stop condition, and said means for controlling said control means operates to stop current flow to said semiconductor device in response to detection of said engine stop condition.

3. A control apparatus according to claim 1, wherein said predetermined time interval varies substantially linearly with variation of said detected water temperature.

4. A control apparatus according to claim 1, wherein said predetermined time interval varies in steps with variation of said detected water temperature.

5. A control apparatus for controlling the dwell time in an ignition circuit of an internal combustion engine by controlling a semiconductor device through which current is supplied to the ignition coil of said ignition circuit, comprising:

a voltage sensor for detecting a battery of said engine;

control means for controlling said semiconductor device to conduct for a dwell time during which current is supplied to said ignition coil;

time setting means for selecting a predetermined time interval which is inversely proportional to detected battery supply voltage level;

discrimination means for detecting that said engine is in a predetermined state when a time period, during which a reference signal from a crank angle sensor is not outputted, is larger than said selected predetermined time interval; and means responsive to said discrimination means detecting said predetermined state for controlling said control means to shorten said dwell time by a predetermined amount.

6. A control apparatus according to claim 5, wherein said predetermined state represents an engine stop condition, and said means for controlling said control means operates to stop current flow to said semiconductor device in response to detection of said engine stop condition.

7. A control apparatus according to claim 5, wherein said predetermined time itnerval varies substantially linearly with variation of said detected battery voltage level.

8. A control apparatus according to claim 5, wherein said predetermined time interval varies in steps with variation of said detected battery voltage level.

9. A control apparatus for controlling the dwell time in an ignition circuit of an internal combustion engine by controlling a semiconductor device through which current is supplied to an ignition coil of said ignition circuit, comprising:

a water temperature sensor for detecting the water temperature of cooling water of said engine;

a voltage sensor for detecting a battery supply voltage level of said engine;

control means for controlling said semiconductor device to conduct for a dwell time during which current is supplied to said ignition coil;

first time setting means for selecting a first predetermined time interval which is inversely proportional to detected water temperature;

second time setting means for selecting a second predetermined time interval which is indirectly proportional to detected battery supply voltage level;

discrimination means for detecting that said engine is in a predetermined state when a time period, during which a reference signal from a crank angle sensor is not outputted, is larger than at least one of said first and second predetermined time intervals; and means responsive to said discrimination means detecting said predetermined state for controlling said control means to shorten said dwell time by a predetermined amount.

10. A control apparatus according to claim 9, wherein said predetermined state represents an engine stop condition, and said means for controlling said control means operates to stop current flow to said semiconductor device in response to detection of said engine stop condition.

11. A control apparatus according to claim 9, wherein said predetermined time interval varies substantially linearly with variation of said detected water temperature.

12. A control apparatus according to claim 9, wherein said predetermined time interval varies in steps with variation of said detected water temperature.

13. A control apparatus according to claim 9, wherein said predetermined time interval varies substantially linearly with variation of said detected battery voltage level.

14. A control apparatus according to claim 9, wherein said second predetermined time interval varies in steps with variation of said detected battery voltage level.

15. A control apparatus according to claim 9, wherein said discrimination means detects that said engine is in said predetermined state when said time period becomes larger than the smaller of said selected first and second predetermined time intervals.

16. A control apparatus according to claim 9, wherein said discrimination means detects that said engine is in said predetermined state when said time period becomes larger than an average value of said selected first and second predetermined time intervals.

17. A control apparatus according to claim 9, wherein said discrimination means detects that said engine is in said predetermined state when said tiem period becomes larger than a value accessed from a map by using values of said selected first and second predetermined time intervals.

* * * * *